US006302824B1

(12) United States Patent
MacAdam et al.

(10) Patent No.: US 6,302,824 B1
(45) Date of Patent: Oct. 16, 2001

(54) PLAYGROUND APPLIANCE

(75) Inventors: Charles Richard MacAdam; Toshiko Horiuchi MacAdam, both of Bridgetown (CA); Norihide Imagawa, Ineshiro (JP)

(73) Assignee: Interplay Design & Manufacturing, Inc, Bridgeton (CA)

( * ) Notice: Subject to any disclaimer, the term of this patent is extended or adjusted under 35 U.S.C. 154(b) by 0 days.

(21) Appl. No.: 09/004,613

(22) Filed: Jan. 8, 1998

(30) Foreign Application Priority Data

Jan. 8, 1997 (CA) ..... 2194647

(51) Int. Cl.[7] ..... A63B 17/00
(52) U.S. Cl. ..... 482/37; 482/35; 482/33
(58) Field of Search ..... 52/295, 296; 482/35–37, 482/23, 24, 25, 33

(56) References Cited

U.S. PATENT DOCUMENTS

| | | | | |
|---|---|---|---|---|
| 3,630,474 | * | 12/1971 | Minor | 52/295 |
| 3,970,301 | | 7/1976 | Lehmann | 272/113 |
| 4,943,046 | | 7/1990 | Beltzig | 272/1 R |
| 5,048,240 | | 9/1991 | Dupre et al. | 52/4 |
| 5,065,975 | | 11/1991 | Giles | 248/545 |
| 5,123,623 | | 6/1992 | McNamara | 248/545 |
| 5,330,400 | * | 7/1994 | Huberman | 482/35 |

FOREIGN PATENT DOCUMENTS

| | | |
|---|---|---|
| 253 9079 | 10/1977 | (DE) . |
| SHO-50-28828 | 8/1975 | (JP) . |
| SHO-58-37427 | 8/1983 | (JP) . |
| SHO-59-25410 | 7/1984 | (JP) . |
| SHO-61-42626 | 12/1986 | (JP) . |

* cited by examiner

*Primary Examiner*—Jerome Donnelly
(74) *Attorney, Agent, or Firm*—Finnegan, Henderson, Farabow, Garrett & Dunner, LLP

(57) ABSTRACT

A playground appliance comprising a plurality of support members from which are suspended net units to form a non-planar playing surface that children can climb. The support members include vertical posts supported on the ground by anchoring devices. Each anchoring device includes a ground engaging support plate having a surface substantially exceeding a transverse dimension of the vertical post. Ground penetrating spike members are driven through the support plate to stabilize the post. The assembly is easy to erect and can sustain heavy loading without collapsing.

13 Claims, 9 Drawing Sheets

PLAYGROUND APPLIANCE

FIELD OF THE INVENTION

The present invention relates to amusement devices, more particularly to a playground appliance comprised of sheet-like membranes suspended from vertical posts to form a plurality of inclined slopes that can be climbed by children. The characterizing element of the invention resides in a novel anchoring device for fastening the vertical posts to the ground without the need of laying concrete foundation blocks.

BACKGROUND OF THE INVENTION

The prior art in the field of playground equipment discloses a variety of structures, particularly for outdoor use, designed to provide a three-dimensional spacial network where children can climb. Examples of such amusement appliances are found in the following Japanese Utility Model publications:

| Serial Number | Publication date | Filing Date | Applicant |
|---|---|---|---|
| SHO-58-37477 | Sept. 17, 1980 | March 7, 1979 | Toshiko Horiuchi |
| SHO-59-25410 | Sept. 8, 1980 | March, 6, 1979 | Toshiko Horiuchi |
| SHO-50-20826 | Feb. 6, 1973 | June 17, 1971 | Mitsuru Senda |

More specifically, the amusement appliances include a series of net units suspended from vertical posts. The attachment points of the individual nets to the respective posts are at different vertical elevations so the nets acquire a non-planar configuration. In a particular embodiment, the individual net units are disposed around a main central post and they are suspended from it at a predetermined distance from the ground, say generally at least two meters. The individual net units slope downwardly, toward smaller posts at the periphery of the spacial-network to hold the free edges of the nets and thus maintain a level of tension and stability in the whole structure.

Advantageously, the net units are made from a material that has a certain resiliency. This feature enables the net units to stretch repeatedly and contract when children climb or jump on them, thus enhancing the overall enjoyment provided by the apparatus. However, this otherwise desirable characteristic leads to an increased strain on the various posts that support the net units above the ground. For instance, when a group of children is climbing and jumping on only one side of the spacial network of net units, rather than being spread over the entire playing surface of the network, significant bending moments are induced particularly in the central post.

One approach of providing a robust supporting structure that is capable to resist the dynamic forces developed when the playing surface of the spacial network is heavily loaded, consists of casting in the ground heavy concrete blocks on which the various posts are anchored. However, this procedure significantly increases the cost of the playground appliance. Further the procedure is suitable only for permanent installations.

OBJECTIVES AND STATEMENT OF THE INVENTION

One object of the invention is a supporting member for use in a playground apparatus that can be secured to the ground without the need of laying a permanent concrete foundation.

Another object of the invention is a playground apparatus utilizing the aforementioned supporting member.

As embodied and broadly described herein, the invention provides a supporting member for use in a playground appliance which is capable of inducing significant bending moments in said supporting member, said supporting member comprising:

an elongate post;

an anchoring device for supporting said elongate post in an upright position on the ground, said anchoring device including:

a) a ground engaging support plate mounted at an end portion of said elongate post, said ground engaging support plate having a surface area substantially exceeding a cross-sectional area of said end portion;

b) a plurality of ground penetrating spike members, each said spike members including a spike head engaging said ground engaging support plate when the spike member is driven in the ground, thereby stabilizing said ground engaging support plate and said elongate post.

In one embodiment, the ground engaging support plate includes four sections which are assembled to receive therebetween a socket in which the lower end of the post is secured. Each section is made of sheet metal and has a main generally planar triangular surface. Two side edges of the triangular section are bent downwardly to form web segments rigidifying the ground engaging plate, also forming anchoring pegs that assist the ground penetrating spike members to stabilize the post, as will be described in greater detail later. The apex of the triangular section is cut out according to a pattern corresponding to a quarter of a circle to clear the post holding socket which is to be secured to the ground engaging support plate.

Alternatively, in a second embodiment, each of the four triangular sections have web sections on all three sides. These web sections extend upwardly from and perpendicular to a bottom planar surface. When the four triangular sections are brought together and fastened at the mating surfaces of the web sections, the four bottom planar surfaces together constitute a square bottom surface whose underside rests on the ground. The post slides into a cylindrical socket, reinforced by circumferential wing ribs, which is welded to a base plate. The base plate is, in turn, bolted to four small plates via four anchor bolts. Depending from the underside of each of the four small plates is a cross-shaped protrusion. When the four small plates are fastened to the base plate, the four cross-shaped protrusions mate with the raised web sections of the four fastened triangular sections. At each corner of the square bottom surface is located a vertical channel that is formed by the mating of adjacent web sections. Through each channel the ground-penetrating spikes are fastened to the triangular sections. This arrangement provides greater overall structural stability when the playground appliance is heavily and asymmetrically loaded. Moreover, the presence of a square bottom surface ensures that the soil beneath it is well compacted and is thus more applicable for varying soil types.

With respect to either embodiment, to assemble the ground engaging support plate, the four triangular sections are placed in a co-planar mating relationship which brings the web segments of adjacent triangular sections in mutual engagement. Suitable fasteners, such as bolts, passing through the abutting web segments secure the triangular sections together. The resulting structure displays a central generally circular opening formed by the cut-outs at the apexes of the individual triangular sections. A metallic sleeve forming the post holding socket is then secured in that circular opening. The longitudinal axis of the socket is oriented transversely to the plane of the ground engaging support plate, whereby when the plate is positioned on the ground the post held in the socket will be oriented generally vertically.

To effect the installation of the playground appliance according to the invention, the ground engaging support plate is placed flat against the ground on the site where the supporting member is to be erected. A plurality of elongate spikes are driven through holes near the periphery of the ground engaging support plate to anchor it in place. Advantageously, the ground-penetrating spikes have threads which significantly increase the anchoring strength at the spike-ground interface. A pull-out strength of 600 kilograms (1320 pounds) has been deemed to provide an ample factor of safety for the expected loads on the structure. Finally, the lower extremity of the post is then inserted in the metallic sleeve and fastened therein with screws or other suitable fasteners.

One or more secondary supporting members are erected on the playground site in a spaced apart relationship with the main supporting member to provide the desired number of anchoring points for holding the sheet-like membrane suspended at the requisite distance above the ground. The secondary supporting members are identical to the main supporting member with the exception that they are shorter so that the sheet-like membrane when installed will form a slope that children can climb.

Preferably, the entire playground site, including the ground engaging support plates of primary and secondary supporting members, is then covered with a layer of sand or similar material.

Advantageously, such the depth of such layer of material is approximately thirty (30) centimeters.

Alternatively, holes adapted to receive the ground engaging support plates of a supporting members are dug into the ground on the site where the supporting member is to be erected. Preferably, the depth of the hole is approximately thirty (30) centimeters. The support plate is then placed within the hole flat against the ground and the plurality of elongate spikes are driven through holes near the periphery of the ground engaging support plate to anchor it in place. The lower extremity of the post is then inserted in the metallic sleeve and fastened therein with screws or other suitable fasteners. Finally, the soil removed from the ground is placed within the hole, covering the support member and a lower portion of the post.

The playground appliance in accordance with the invention works surprisingly well. Tests conducted by the present inventor have demonstrated that the supporting members are highly resistant to bending stresses induced by a heavy loading of the sheet-like membranes. Without the intent of being bound by a specific theory, the inventor believes that the broad surface of the ground engaging support plate, advantageously coupled with the layer of covering material, efficiently transmits successive bending shocks to the ground, occurring when a group of children jumps on the sheet-like membrane, where those shocks can be damped. As a result, a very robust structure is provided which can support a significant weight in spite of the fact that no concrete foundation blocks are used to anchor the posts holding the sheet-like membrane.

The advantages of the invention are immediately apparent. Since there is no need to lay any permanent foundation, the playground appliance can be erected at a low cost and within a very short period of time. In addition, the appliance can be easily disassembled for storage purposes when it is no longer required such as during the winter season.

As embodied and broadly described herein, the invention also provides a playground appliance comprising:

- a first supporting member, including:
  - a) an elongate post;
  - b) an anchoring device for supporting said elongate post in an upright position, said anchoring device including:
    - i) a ground engaging support plate mounted at an end portion of said elongate post, said ground engaging support plate having a surface area substantially exceeding a cross-sectional area of said end portion;
    - ii) a plurality of ground penetrating spike members, each said spike members including a spike head engaging said ground engaging support plate when the spike member is driven in the ground, thereby stabilizing said ground engaging support plate and said elongate post;
- a second supporting member for securement on the ground in a spaced apart relationship with said first supporting member; and
- a flexible sheet-like membrane capable of being suspended from said support members to provide a playing surface at a certain distance above the ground.

In a most preferred embodiment, the flexible sheet-like membrane is formed by a network of crossing strands constituting a net. It may also be envisaged to employ a fabric, film or any other suitable membrane-type material that can be hung from a plurality of discrete sites in a sling-like configuration.

DESCRIPTION OF A PREFERRED EMBODIMENT

Figure 1:
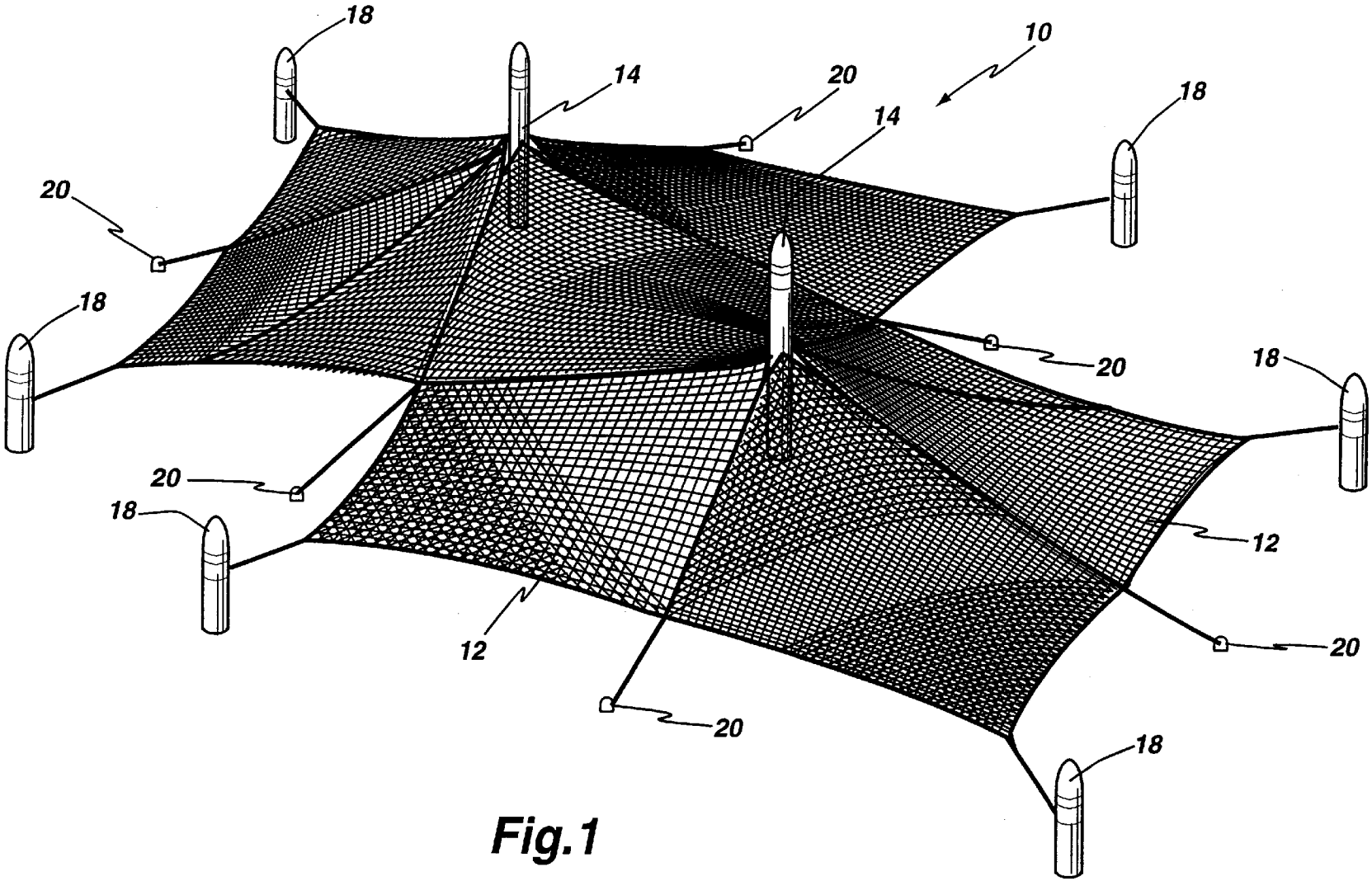
FIG. 1 is a perspective view of a multi-net playground appliance constructed in accordance with the present invention.
Figure 2:
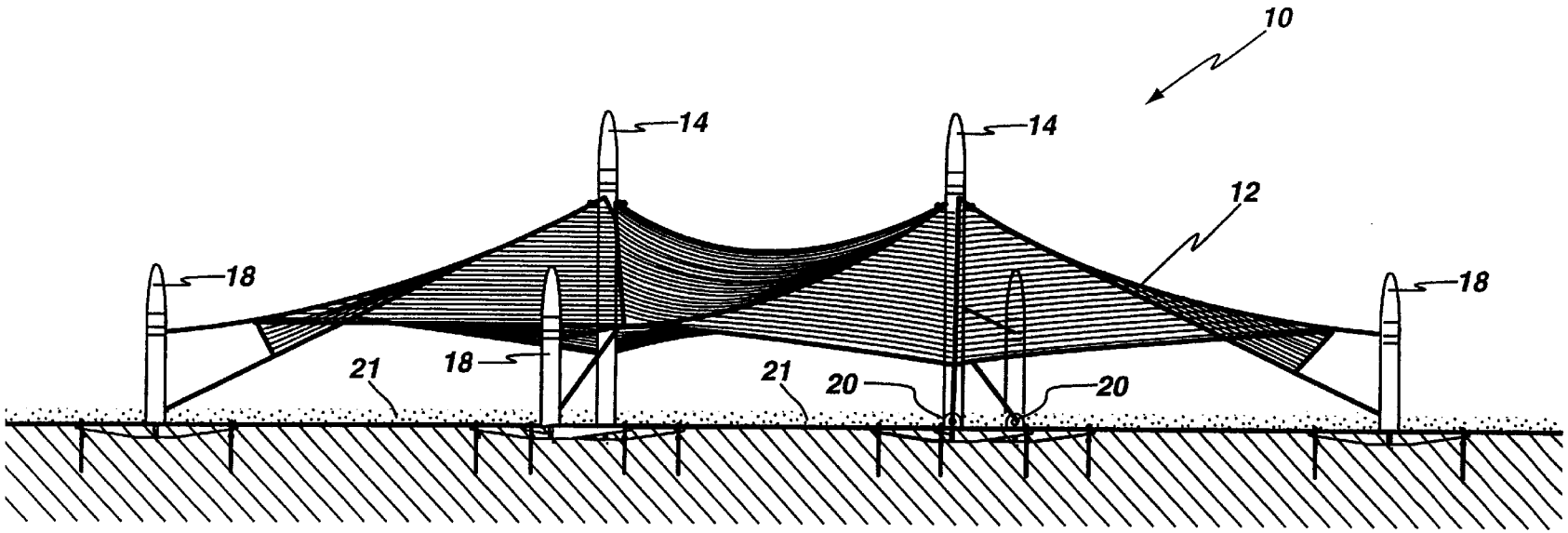
FIG. 2 is a side elevational view of the playground appliance shown in FIG. 1.

FIGS. 1 and 2 illustrate a specific embodiment of a playground appliance which is comprehensively designated by the reference numeral 10. The appliance 10 includes a plurality of individual net units 12 suspended from a multitude of support members at a distance above the ground to form a non-planar playing surface on which children can climb for amusement purposes.

The individual net units 12 have a rectangular configuration and they are constituted by a network of crossing strands. In a specific example, the net is knotted mesh made from braided fibre with the necessary strength and resilience, such as nylon, the openings in the mesh being sufficiently large to provide a grip or foothold but not so large as to allow a child's hand or foot to pass through (in practice, a mesh size of about 50 mm×50 mm when the net is stretched has been found satisfactory) . Knots at the strand crossings help stabilize the mesh and give it the character of a membrane when placed under tension. Each net unit is bounded by an edge rope which helps distribute the strain on the net. Where the net is suspended from one or more of the central posts, a suitable metal fitting passing through the edge rope provides a means of attachment to the post.

Gradually the net will lose elasticity and begin to stretch. In time it could stretch to a point where it comes in contact with the ground when one or more children climb or jump on it creating a potential safety hazard. To avoid this, those corners of the net not suspended from a central post are attached by means of ropes to secondary posts or ground hooks, and these ropes can be shortened as the net stretches to maintain the requisite tension. The nets are arranged in a way that minimizes the number of attachments where metal fittings are used. This arrangement gives the net a more dynamic character and these points are also less apt to cause abrasion of the edge rope.

The array of support members used for holding the net unit above the ground includes two main support elements 14 in the form of vertically oriented elongate posts located within the boundary of the playing surface. Outside the boundary of the playing surface are provided a plurality of secondary support members to which the marginal portions of the individual net units 12 are secured to provide the requisite level of tension on the playing surface. The secondary support members can be divided into two categories, there being large secondary support members 18 to which connect the corners of respective net units 12, and small secondary support members 20 which connect the straight edges of the net unit to achieve further stabilization of the assembly. The small secondary support members 20 provide a point of attachment at ground level and are used to draw the nets downward, at a steeper angle as compared with the large secondary support members 18. The small secondary support members 20 alternate with the secondary support member 18 around the perimeter of the net so that every corner of the net is attached to a secondary support member. Finally, as illustrated in FIG. 2, the entire playground site, including the support plates of all of the supporting members, is covered with a layer of sand 21.

Figure 3:
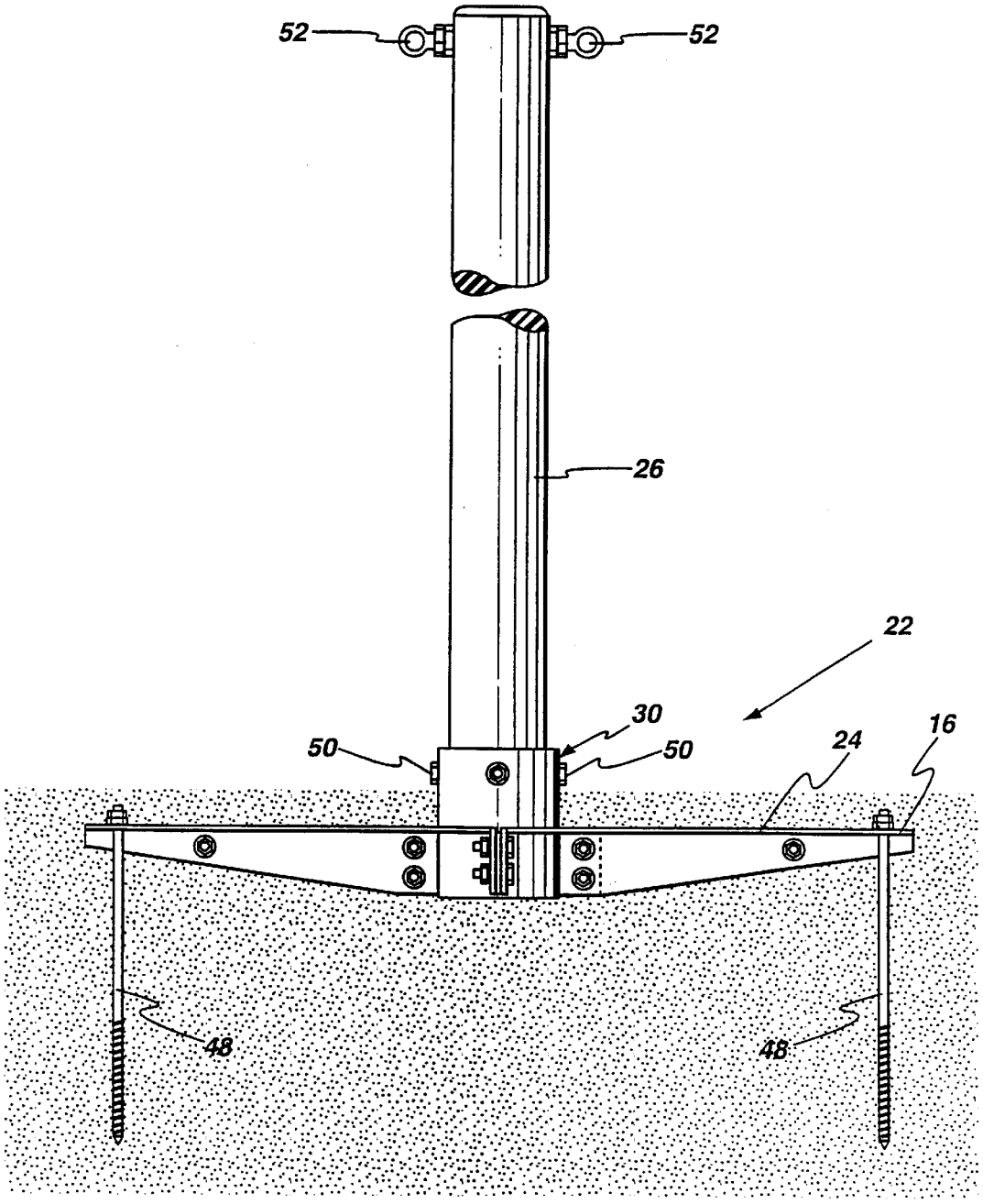
FIG. 3 is a side elevational view of a main support member of the playground appliance in accordance with the invention.

The present invention provides a novel device for anchoring the support member 14, 18 and 20 that does not require a permanent foundation to achieve the desired level of stability. The overall structure of the anchoring device is best shown in FIG. 3, which depicts in side elevation the main support member 14. The anchoring device 22 includes a plate 24 secured to the lower end of a post 26 forming the main body of the support member 14. The plate 24 has a surface that substantially exceeds the cross-sectional dimension of the post 26.

Figure 6:
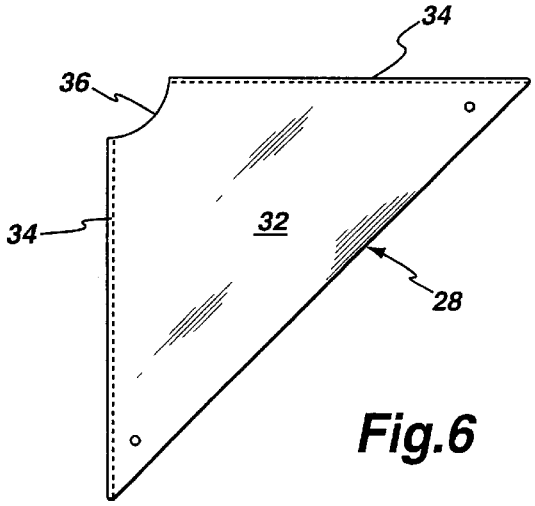
FIG. 6 is a top plan view of a triangular segment of the ground engaging support plate.

The plate 24 is an assembly of generally triangular sections 28 from which projects a transversely extending sleeve 30 constituting a socket in which is held the lower extremity of the post 26. The structure of each triangular section 26 is shown with greater detail on FIG. 6. The triangular section includes a top planar surface 32 from which depend perpendicularly extending web sections 34. The web sections 34 are drilled to accommodate bolts required during the assembly of the triangular sections 28.

The apex of each triangular section 28 is cut according to a pattern 36 corresponding to a quarter of a circle to accommodate the post holding socket 30. Most preferably, the triangular sections 28 are manufactured from steel sheet metal having a thickness of about 9 mm. The metal may be galvanized for corrosion resistance.

Figure 8:
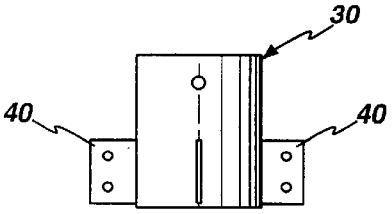
FIG. 8 is a aide elevational view of a post holding socket of the ground engaging support plate.
Figure 7:
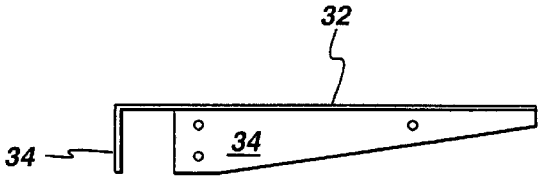
FIG. 7 is a side elevational view of the triangular segment shown in FIG. 6.
Figure 9:
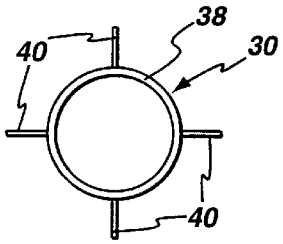
FIG. 9 is a top plan view of the post holding socket shown in FIG. 8.

The structure of the post holding socket 30 will now be described in connection with FIGS. 8 and 9. The socket 30 is essentially a metallic tube 38 having a diameter selected to achieve a tight fit with the lower extremity of the post 26. Four equi-spaced mounting plates 40 are welded to the tube 38 and extend radially therefrom. The mounting plates are drilled to accept bolts installed during the assembly of the anchoring device 22.

Figure 5:
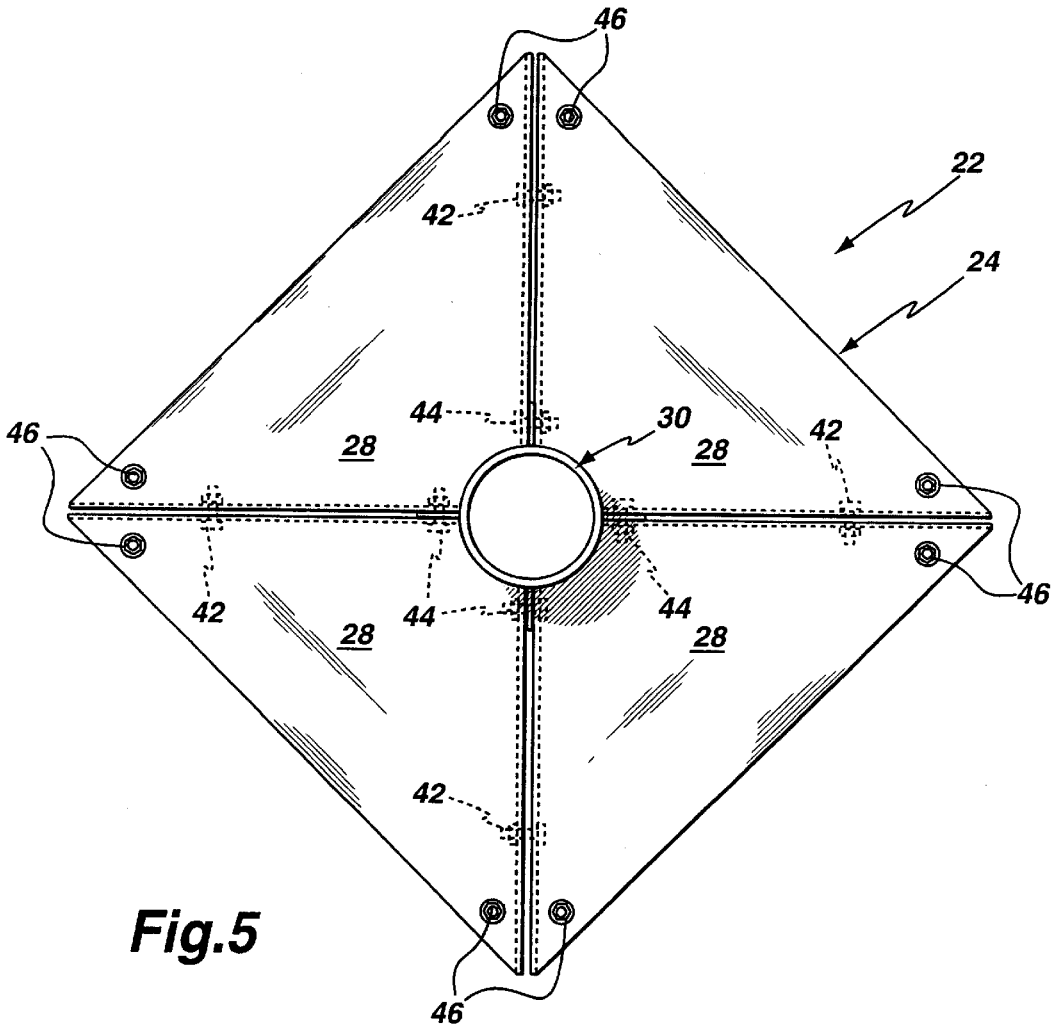
FIG. 5 is a top plan view of the ground engaging support plate shown in FIG. 4.
Figure 4:
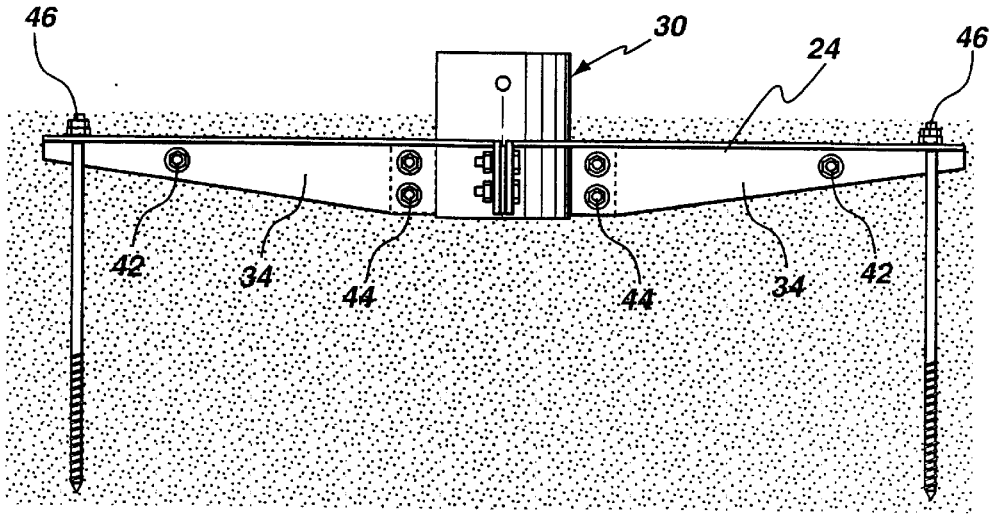
FIG. 4 is a side elevational view of the ground engaging support plate of the support member shown in FIG. 3.

The assembly procedure of the anchoring device 22 consists of placing the triangular plates 28 in a mating relationship so the web sections 34 of adjacent triangular section abut against one another. A first set of bolts 42 (please refer to FIG. 5) are tightened near the periphery of the plate 24. Next, the socket 30 is mounted in the central opening formed by the cut-out portions 36. Note that the plates 40 fit between adjacent web sections 36 and their holes line-up with the apertures provided in those web sections to receive bolts. Another series of bolts 44 is then installed to lock the post holding socket 30 to the plate 24.

The anchoring device 22 is also provided with a pair of holes 46 near each corner of the rectangular surface 24 for receiving ground penetrating spikes 48. Each spike is in the form of an elongated treated metallic rod with a pair of double nuts engaged near its upper extremity to form a head that bears against the plate 24 when the spikes 48 are driven in the ground.

The post 26 may be made of wood or any other suitable material. Its lower extremity is received in the socket 30 and fastened therein by screws 50 (see FIG. 3). Alternatively, where the posts of are a suitable material, the equi-spaced mounting plates 40 may be directly attached at the bottom for securing the plate 24 without the need for a post holding socket. The upper extremity of the post 26 is provided with eye-nuts 52 to provide attachment points for the net units 12.

The structure of the secondary large support member 18 is identical to the main support member 14, which is described above, with the exception that the post 26 is made somewhat shorter for providing an anchoring point for a net 12 that is at a lower elevation with relation to the ground surface.

Figure 10:
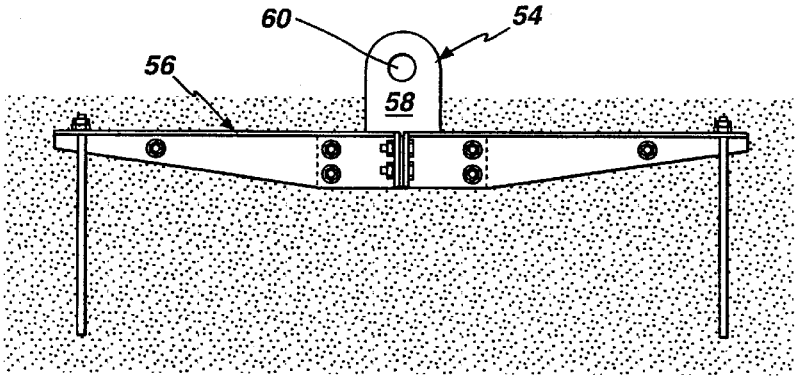
FIG. 10 is a side elevational view of a secondary support member of the playground appliance in accordance with the invention.

The structure of a small secondary support member 20 is shown in FIG. 10. Again, its structure is similar to the support member 14 described above with the exception that the post is integrally formed with the anchoring device. More specifically, the post is in the form of a metallic plate 54 having the shape of an inverted T, comprising a base 56 and an upwardly projecting shank 58. The base 56 is clamped between the web sections of adjacent triangular sections 24, the shank 58 includes a hole 60 through which a tether line emerging from a net 12 can be attached.

Figure 15:
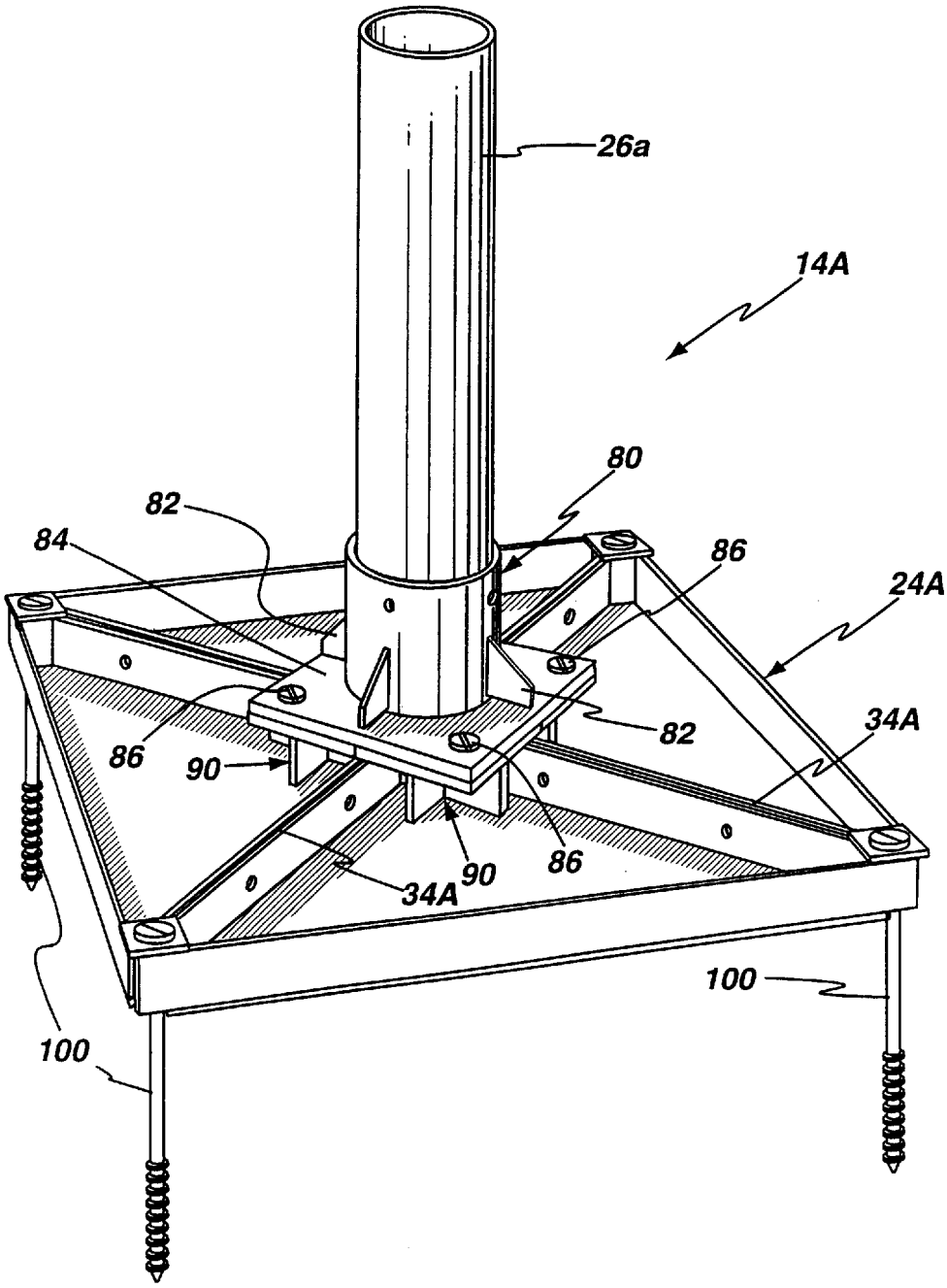
FIG. 15 is a perspective view of the most preferred embodiment of the main support member.

Referring to FIGS. 12 through 16, in the second embodiment of the present invention, the support member 14A comprises a post 26 and a cylindrical socket 80 into which the post 26A is slidingly engaged. The cylindrical socket 80 is welded to a base plate 84 and reinforced by four wing ribs 82. The base plate 84 is pierced by four holes through which anchor bolts 86 fasten the base plate 84 to four small plates 90. Depending from the underside of each of the small plates 90 is a cross-shaped protrusion 92. When the four small plates 90 are bolted to the base plate 84, the cross-shaped protrusions 92 are spaced apart as shown in FIG. 15 such that the cross-shaped protrusions mate with the web sections 34A of the assembled triangular sections 24A. The four small plates 90 are then welded to the web sections 34A. Finally, four screw anchors 100 penetrate the ground and restrain the support member 14A through vertical channels 96 formed by the mating web sections 34A.

To install the playground apparatus 10, the supporting members are assembled as previously described and placed on the ground at the desired locations. The ground penetrating spikes 48 are then driven in the soil. The required length of the spikes 46 will depend on the kind of soil on which the installation can be made.

Figure 11:
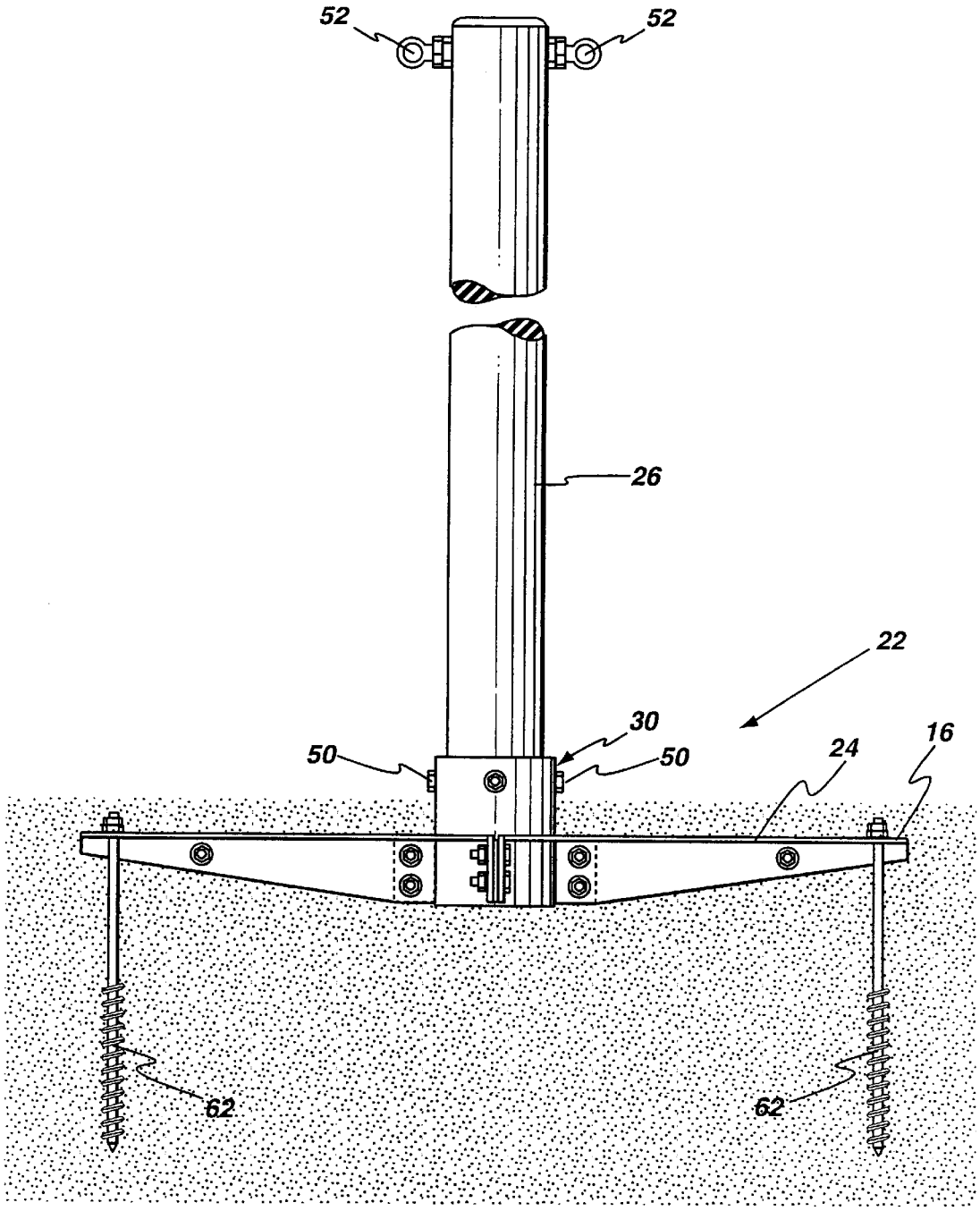
FIG. 11 is a side elevational view of a variant of a main support member of the playground appliance in accordance with the invention.
Figure 12:
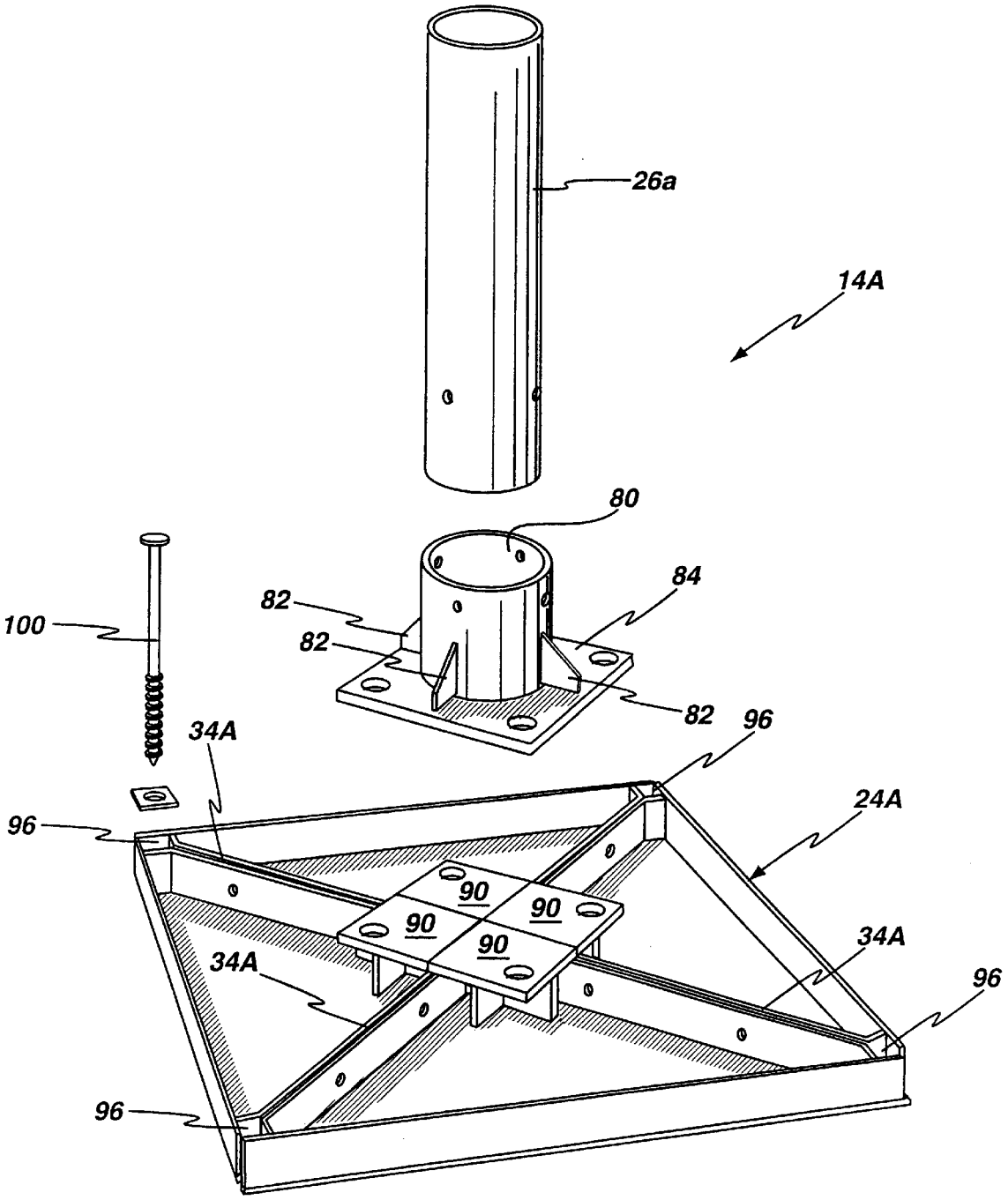
FIG. 12 is an exploded perspective view of the most preferred embodiment of the main support member of the playground appliance in accordance with the invention.
Figure 14:
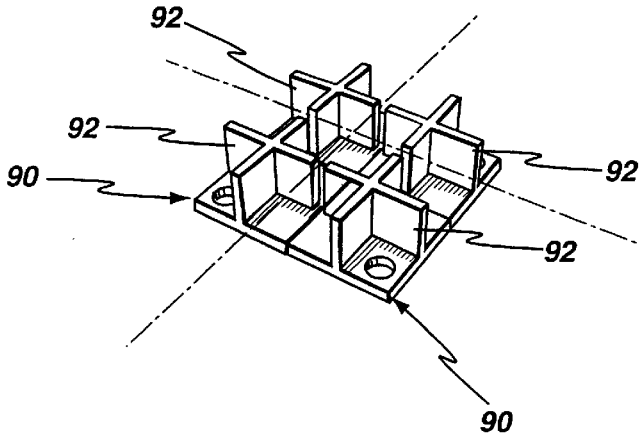
FIG. 14 is a perspective view of the underside of the four small plates of FIG. 13 showing the cross-shaped protrusions.
Figure 13:
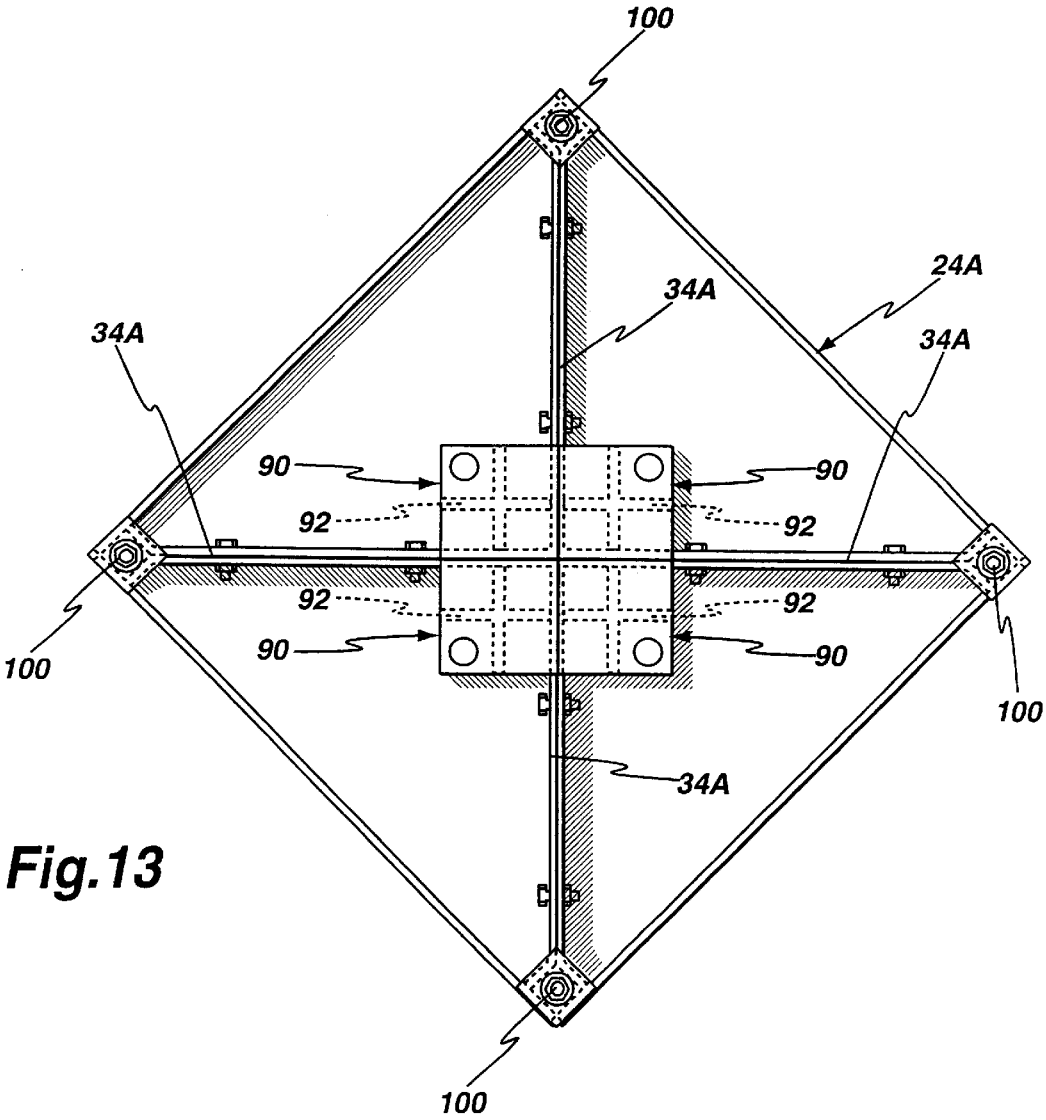
FIG. 13 is a top plan view of the ground engaging support plate shown in FIG. 12.

In the variant illustrated at FIG. 11, the ground penetrating spikes 48 are provided with large screw threads 62 that can significantly increase the holding force of the spikes. Contrary to the previous embodiment, where the holding force is generated solely by friction developed between the surface of the spikes and the ground, the screws shaped spikes create an interference fit due to the overlap of material soil/screw thread to better resist pulling efforts during a heavy loading of the nets.

The screw threaded spikes are driven into the ground by moderately pounding on them to obtain an initial engagement and then turning the heads of the spikes with a suitable wrench to drive the threads in the soil. The transverse dimension of the treads and their length (the length of the section of the spike provided with treads) influences the holding force. Generally, by increasing the diameter of the treads and/or increasing the length of the threads the holding force increases. Larger and longer threads are desirable for installations where the soil is soft or has a large proportion of granular material such as gravel or sand.

When the support member is installed, the Lop surface of the anchoring device that corresponds with the horizontal surface of the plate 24 is flush with the ground surface The downwardly projecting web sections 34 are firmly planted in the ground and contribute, in connection with the spikes 48 to stabilize the assembly. By providing an anchoring device 22 which has a ground engaging surface (corresponding to the surface area of the underside of the plate 24) that is significantly larger than the cross-sectional dimension of the post 26, shocks transmitted to the supporting members are transmitted to the ground and damped therein and as a consequence the playground appliance may be subjected to heavy loading without causing the supporting members to collapse.

Once the supporting members have been installed in the ground as described earlier, the sand is placed over the entire surface area. The last step of the installation procedure of the playground appliance consists of hanging the net units 12 to their respective support members. After this step is completed, the playground appliance is ready for use.

The above description of the invention should not be interpreted in any limiting manner as refinements and variations are possible without departing from the spirit of the invention. The scope of the invention is defined in the appended claims and their equivalents.

The embodiments of the invention for which an exclusive property or privilege is claimed are defined as follows:

1. A playground appliance, comprising:

(a) a first supporting member for securement on the ground, including an elongate post having an end portion and an anchoring device for supporting said elongate post in a generally vertical position, said anchoring device including:

i) a ground engaging support plate mounted at said end portion, said ground engaging support plate having a surface area substantially exceeding a cross-sectional area of said end portion; and ii) a plurality of ground penetrating fastener members, each said fastener members including a fastener head engaging said ground engaging support plate when the fastener member is driven in the ground, thereby stabilizing said ground engaging support plate and said elongate post;

(b) a second supporting member for securement on the ground in a position remote from said first supporting member, said second supporting member including an elongate post having an end portion and an anchoring device for supporting the elongate post of said second supporting member in a generally vertical position and in a position remote from the elongate post of said first supporting member, the anchoring device of said second supporting member including:

i) a ground engaging support plate mounted at said end portion of the elongate post of said second supporting member, the ground engaging support plate of the elongate post of said second supporting member having a surface area substantially exceeding a cross-sectional area of said end portion of the elongate post of said second supporting member; and ii) a plurality of ground penetrating fastener members, each said fastener members including a fastener head engaging the ground engaging support plate of the elongate post of said second supporting member when the fastener member is driven in the ground, thereby stabilizing the ground engaging support plate and the elongate post of said second supporting member;

(c) a flexible sheet-like membrane capable of being suspended from said supporting members to provide a playing surface at a distance above the ground.

2. A playground appliance as defined in claim 1, wherein said ground engaging plate comprises a plurality of apertures for receiving said ground penetrating spike members.

3. A playground appliance as defined in claim 1, comprising a socket mounted to said ground engaging support plate for receiving a lower extremity of said post.

4. A playground appliance as defined in claim 3, wherein said socket comprises a sleeve defining a cavity for receiving said lower extremity of said post, said sleeve having a longitudinal axis that extends generally transversely with relation to said ground engaging support plate.

5. A playground appliance as defined in claim 4, wherein said cavity is generally circular.

6. A playground appliance as defined in claim 1, wherein said ground engaging support plate includes at least one downwardly projecting rigidifying webs.

7. A playground appliance as defined in claim 6, wherein said ground engaging support plate includes a pair of elongate downwardly projecting webs extending at an angle one with relation to the other.

8. A playground appliance as defined in claim 1, wherein at least one of said ground penetrating spike members includes threads allowing the ground penetrating spike member to be screwed in the ground.

9. A playground appliance comprising:

(a) first supporting member for securement on the ground, including an elongate post having an end portion and an anchoring device for supporting said elongate post in a generally vertical position, said anchoring device including:

i) a ground engaging support plate mounted at said end portion, said ground engaging support plate having a surface area substantially exceeding a cross-sectional area of said end portion;

ii) a plurality of ground penetrating screw anchors, each said screw anchors including a head engaging said ground engaging support plate when the screw anchor is driven in the ground, thereby stabilizing said ground engaging support plate and said elongate post; and iii) a receptacle capable of receiving and restraining said elongate post, said receptacle being rigidly mounted to said ground engaging support plate;

(b) a second supporting member for securement on the ground in a position remote from said first supporting member, said second supporting member including an elongate post having an end portion and an anchoring device for supporting the elongate post of said second supporting member in a generally vertical position and in a position remote from the elongate post of said first supporting member, the anchoring device of said second supporting member including:

i) a ground engaging support plate mounted at said end portion of the elongate post of said second supporting member, the ground engaging support plate of the elongate post of said second supporting member having a surface area substantially exceeding a cross-sectional area of said end portion of the elongate post of said second supporting member;

ii) a plurality of ground penetrating screw anchors, each said screw anchors including a head engaging the ground engaging support plate of the elongate post of said second support member when the screw anchor is driven in the ground, thereby stabilizing the ground engaging support plate and the elongate post of said second supporting member; and iii) a receptacle capable of receiving and restraining the elongate post of said second support member, said receptacle being rigidly mounted to the ground engaging support plate of the elongate post of said second supporting member;

(c) a flexible sheet-like membrane capable of being suspended from said supporting members to provide a playing surface at a distance above the ground.

10. A playground appliance as defined in claim 9, wherein said ground engaging support plate includes upwardly projecting webs substantially perpendicular to the ground engaging support plate.

11. A playground appliance as defined in claim 10, wherein said upwardly projecting webs form a cross-shaped pattern upon.

12. A playground appliance as defined in claim 10, wherein the upwardly projecting webs form vertical channels at corners of said ground engaging support plate through which said screw anchors may be received to penetrate the ground and restrain the playground appliance.

13. A playground appliance comprising:

(a) first supporting member secured on the ground in a generally vertical position, including an elongate post having an end portion and an anchoring device supporting said elongate post in a generally vertical position on the ground, said anchoring device including:

i) a ground engaging support plate mounted at said end portion, said ground engaging support plate having a surface area substantially exceeding a cross-sectional area of said end portion; and ii) a plurality of ground penetrating fastener members driven in the ground, each said fastener members including a fastener head engaging said ground engaging support plate, thereby stabilizing said ground engaging support plate and said elongate post;

iii) a layer of sand covering said ground engaging support plate to further stabilize said first supporting member on the ground;

(b) a second supporting member secured on the ground in a generally vertical position and in a position remote from said first supporting member, said second supporting member including an elongate post having an end portion and an anchoring device supporting the elongate post of said second supporting member on the ground in a generally vertical position and in a position remote from the elongate post of said first supporting member, the anchoring device of said second supporting member including:

i) a ground engaging support plate mounted at said end portion of the elongate post of said second supporting member, the ground engaging support plate of the elongate post of said second supporting member having a surface area substantially exceeding a cross-sectional area of said end portion of the elongate post of said second supporting member; and ii) a plurality of ground penetrating fastener members driven in the ground, each fastener member of said second supporting member including a fastener head engaging the ground engaging support plate of said second supporting member, thereby stabilizing the ground engaging support plate of said second supporting member and the elongate post of said second supporting member;

iii) a layer of sand covering the ground engaging support plate of said second supporting member for further stabilizing said second supporting member on the ground;

(c) a flexible sheet-like membrane capable of being suspended from said supporting members to provide a playing surface at a distance above the ground.

* * * * *